United States Patent [19]

Murphy

[11] 4,229,032

[45] Oct. 21, 1980

[54] UNIVERSAL IMPLEMENT FOR CLEANING CORRUGATED SURFACES

[75] Inventor: Michael R. Murphy, Louisville, Ky.

[73] Assignee: The Murphy Advantage Corporation, Louisville, Ky.

[21] Appl. No.: 19,102

[22] Filed: Mar. 9, 1979

[51] Int. Cl.[3] ..... A01B 1/20

[52] U.S. Cl. ..... 294/51; 15/236 R

[58] Field of Search ..... 294/51, 50.9, 50.8, 294/50.6, 50; 15/104 R, 104.5, 104.16, 197, 236 R; 30/136, 164.5

[56] References Cited

U.S. PATENT DOCUMENTS

| | | | |
|---|---|---|---|
| 674,117 | 5/1901 | Lefebvre | 294/51 |
| 1,008,382 | 11/1911 | Sourek | 15/197 |
| 1,435,061 | 11/1922 | Halsey | 294/51 |
| 2,236,093 | 3/1941 | Friend | 15/236 R |
| 3,803,662 | 4/1974 | Glefg | 15/104.5 |
| 3,994,040 | 11/1976 | DiStefano | 15/236 R |

*Primary Examiner*—James B. Marbert

*Attorney, Agent, or Firm*—Edward A. Gerlaugh

[57] ABSTRACT

A reefer scoop having a plurality of teeth for scraping the icy encrustation from corrugated surfaces such as those commonly found in refrigerated trucks, trailers and containers; the teeth are universally adjustable to accommodate a variety of corrugation spacings, and the scoop is quickly and easily converted by means of rotating the blade for use as a conventional shovel.

16 Claims, 6 Drawing Figures

UNIVERSAL IMPLEMENT FOR CLEANING CORRUGATED SURFACES

BACKGROUND OF THE INVENTION

The invention relates to implements for cleaning corrugated surfaces, and, more particularly to a hand manipulable shovel having scraping members adapted to fit into the channels of corrugated surfaces inside refrigerated containers.

The transportation of perishable commodities in insulated refrigerated bodies such as trucks, trailers, and containers continues to grow in importance as a factor in the distribution of many of the world's staple foodstuffs, produce, and processed foods. Although trucks, trailers and containers are usually considered a means of transportation only, the use of refrigerated bodies, particularly containers, for temporary storage space, as for example at transportation terminals, is becoming increasingly important as the entire transportation industry further implements the use of and attempts to establish standards of size and constuction for containers having intermodal applications. Highway trailers, separated from their tractors, are carried on railroad flatcars. Trucks and trailers with tractors are driven onto ships. Containers are carried on truck chassis, on railroad flatcars, above and below deck on container ships, and in limited applications, on cargo aircraft.

The trend in the manufacturing of refrigerated insulated bodies continues toward all metal, metal-plastic, or all plastic construction in order to achieve a strong, durable and lightweight body in which the insulation will stay dry, thus maintaining its insulating value. With respect to the requirement for strength, the floors of most containers, trailers and trucks must be constructed to support the weight of a forklift or the like driven inside the refrigerated body to load and unload cargo.

Circulation of chilled air inside a refrigerated body is another important consideration; inadequate air distribution is a principal cause of improper refrigeration of cargo. Because air moves along paths of least resistance, negligible moving chilled air penetrates interstices of non-respiring cargo. Accordingly, a supply of refrigerated air is often directed to channels or grooves in the interior surfaces of the container itself. Movement of chilled air upward from floor channels is efficatious for preserving respiring cargo such as fresh produce. Thus, prefabricated corrugated material having channels for air circulation is widely used for the interior surfaces of refrigerated bodies.

In order to satisfy the requirements for the support of heavy weight such as a forklift and the adequate delivery and circulation of air under the load, the floors of many refrigerated bodies are constructed of corrugated material which is inherently strong by virtue of the corrugations, and also has channels or grooves along which chilled air may flow, the load being supported above the channels by the adjacent ridges of the corrugation. The grooves and ridges are characteristically straight, parallel, regularly spaced apart and equally indented; however deviations from such regularity may occur both in manufacturing and due to abuse as will be explained hereinafter.

Corrugated surfaces of refrigerated bodies are difficult to clean, particularly when the channels become encrusted with ice and the residue and/or remnants of the refrigerated cargo. Truck drivers and others required to clean the interior surfaces of refrigerated bodies of such frozen encrustations in order to maintain an efficient cooling environment have been faced with a frustrating and time consuming task because no suitable cleaning implement existed. Standard shovels are inadaquate because the shovel blade cannot clean the channels of the corrugated surfaces. Implements such as rakes or ice chippers having a plurality of fixed, regularly spaced teeth or tines are not suitable because in most instances the teeth will not fit into the channels of the corrugation. The distance between channels of the corrugation may vary considerably from one container to another because of a lack of manufacturing standards relating to corrugated surfaces in refrigerated bodies; furthermore, variations may even occur within a single unit where prefabricated corrugated sheets from more than one source are utilized to form a single large surface, as for example, the bed of a refrigerated trailer body. Rakes or chipping implements having fixed, regularly spaced teeth designed to fit into corrugations of corresponding spacing, have often proved ineffective and not usable because of irregularities in the parallelism of the corrugations introduced as a result of damage from heavy loads, forklifts or the like.

Single tined implements have been partially effective in cleaning the corrugated surfaces, but the process of cleaning each channel or groove individually is too time-consuming. Moreover, there is a tendency for the icy encrustation being removed from one channel to fall into an adjacent, previously cleaned channel. In order to achieve effective cleaning of a refrigerated body it has often been necessary to completely defrost the unit and clean the corrugated surfaces with high pressure steam and water to remove all the icy encrustation. Such a complete cleaning is also excessively time consuming and cannot be done at many terminals which lack the equipment and facilities for such operations. Additionally, it is often necessary to clean only a portion of a refrigerated body, for example, upon removing part of the cargo of a highway long-haul trailer and prior to loading other cargo for continuation of the haul. Accordingly, there is a need for an implement, preferably in the form of a hand manipulable tool, for cleaning the icy encrustation from the channels of corrugated surfaces inside refrigerated bodies.

It is, therefore, a general object of my invention to provide an improved implement for cleaning corrugated surfaces.

It is a more specific object of my invention to provide an improved shovel having scraping members adapted to fit into channels of corrugated surfaces.

Another object of my invention is to provide an improved hand manipulable implement for cleaning quickly and efficiently the corrugated surfaces inside refrigerated bodies, which implement is universally adaptable to fit an infinite variety of different sized regular spacings between parallel channels of the corrugated surfaces while sliding along the channels without binding as a result of irregularities which may exist in the parallelism of the channels.

Yet another object of my invention is to provide an improved hand manipulable shovel for scooping quickly and simply foreign matter from channels of corrugated surfaces, which implement may be easily and quickly converted for use as a conventional shovel for cleaning relatively flat surfaces.

It is also an object of my invention to provide an improved hand manipulable implement having a plurality of working teeth for cleaning grooves of corrugated surfaces and a plurality of spare teeth which form a functional part of the implement and may be quickly and easily substituted for broken or damaged teeth.

SUMMARY OF THE INVENTION

The foregoing objects ae achieved according to the instant invention by providing a hand-manipulable implement for cleaning corrugated surfaces such as those found inside refrigerated bodies of trucks, trailers and other containers. The implement comprises an elongate handle, a rectangular blade having two oppositely disposed parallel working edges, means for rotatably attaching the blade and the handle, and means for locking the blade and handle together in a mutually coplanar relationship with the working edges perpendicular to the handle and one or the other of the working edges in a working position oppositely disposed from the handle. One of the two working edges is provided with a plurality of teeth generally parallel to the handle, regularly spaced along the edge and extending outwardly therefrom. During a cleaning operation of a corrugated surface, the teeth are engageable in grooves of the corrugation while the working edge from which the teeth extend scrapes the ridges of the corrugation. In order to accommodate differently spaced corrugations, the teeth are laterally slidable along the edge to change the spacing therebetween while still maintaining the regularity of spacing. During use of the implement, the teeth are also laterally slidable to accommodate any irregularities which may be present in the corrugation. By rotating the blade and locking it with the other edge in the working position, the implement is usable as a conventional shovel or scoop. The teeth are formed as symmetrical elongate scraping members, each having a central hub and a single flat surface abutting the surface of the blade, one end of the flat surface extending outward in cantilevered fashion from the edge of the blade serving as the tooth. The end of the scraping member opposite the cantilevered end serves as a spare tooth. The scraping members are held in place by the rotatable attachment means and are thus rotatable with the blade. The scraping members are separated from each other on the rotatable attachment means by coil springs.

BRIEF DESCRIPTION OF THE DRAWING

The invention is pointed out with particularity in the apended claims; however, the other objects and features of my invention will become apparent and the invention itself will best be understood by referring to the following description and embodiments taken in conjunction with the accompanying drawing, in which:

DETAILED DESCRIPTION OF THE INVENTION

Figure 1:
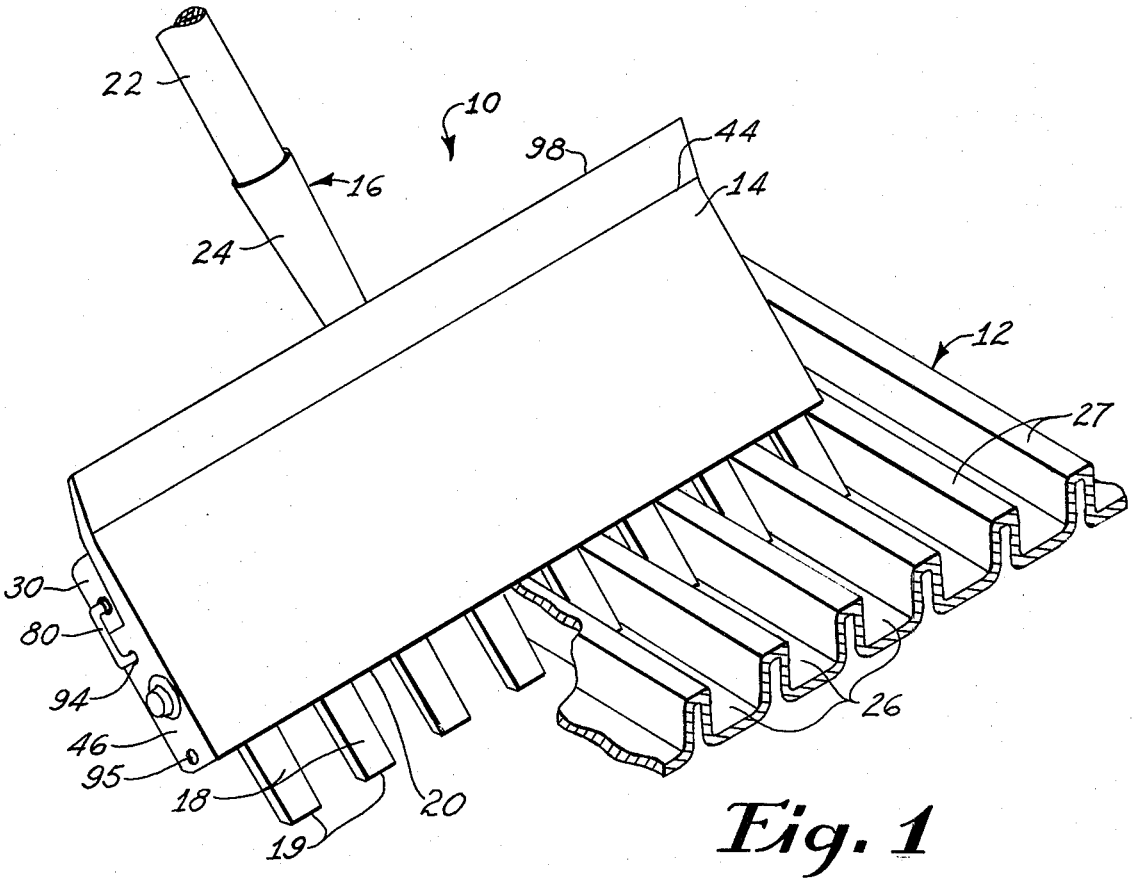
FIG. 1 is a perspective view of one embodiment of the implement of the present invention with a handle shown fragmentarily and the blade oriented with the teeth in a working position for cleaning a corrugated surface, the latter also shown fragmentarily.

Referring now to the various views of the drawing for a more detailed description of the construction, operation and other features of the invention by characters of reference, FIG. 1 shows a hand manipulable tool or implement 10 for cleaning a corrugated surface 12. The surface 12 may be, for example, the interior surface of the bed of a refrigerated truck body which is formed characteristically of a strong, lightweight metal alloy such as those of aluminum or magnesium. The implement 10 includes a blade 14, a handle assembly 16 and a plurality of scraping members 18 projecting outwardly as teeth 19 from a first working edge 20 of the blade 14. The handle assembly 16 includes an elongate handle 22, shown fragmentarily, which may be of wood or any suitable material, and a sleeve 24 into which an end of the handle 22 is compressively inserted. Although the sleeve 24 is shown as generally frustoconical in shape, it may be cylindrical as well, and the handle 22 may be joined to the sleeve 24 by means other than compression as for example with suitable fasteners such as bolts or rivets (not shown). The blade 14 and the elongate handle 22 are generally coplanar as in any conventional shovel, the working edge 20 being perpendicular to the handle and oppositely disposed on the blade 14 therefrom.

Figure 2:
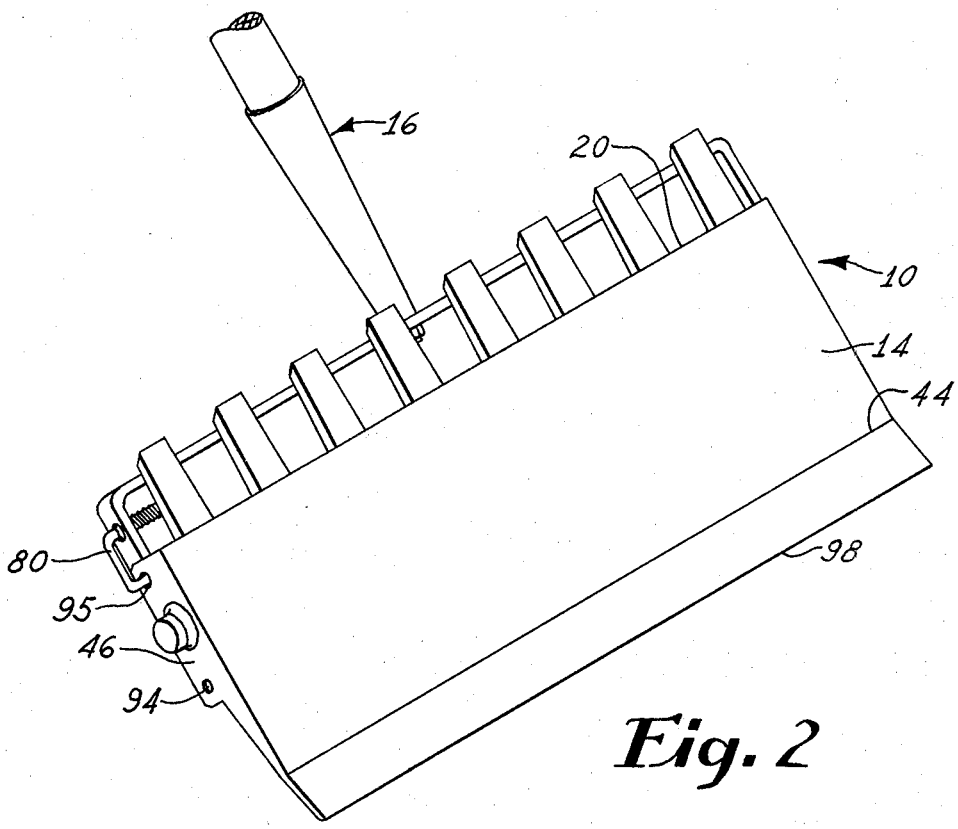
FIG. 2 is a perspective view of the embodiment of FIG. 1 with the blade rotated 180° from the position of FIG. 1 and oriented for use as a conventional shovel or scoop.

The implement 10 is constructed to provide selective and optional use of the scraping members 18, thereby providing a dual purpose use as an implement for cleaning and scooping debris from corrugated surface 12 as depicted in FIG. 1, and as a conventional shovel as shown in FIG. 2. Referring to FIG. 1, the teeth 19 are so positioned regularly along the edge 20 that each will fit loosely into a corresponding one of a plurality of channels 26 of the corrugated surface 12, the channels 26 having the same spacing therebetween as the spacing between adjacent ones of the teeth 19. By adjusting the angle of the implement 10 with respect to the surface 12, the working edge 20 rests on ridges 27 of the corrugation while the teeth 19 rest in the bottom of the channels 26. Shoveling action imparted to the implement 10 thus results in scraping both the channels 26 and the ridges 27.

Figure 3:
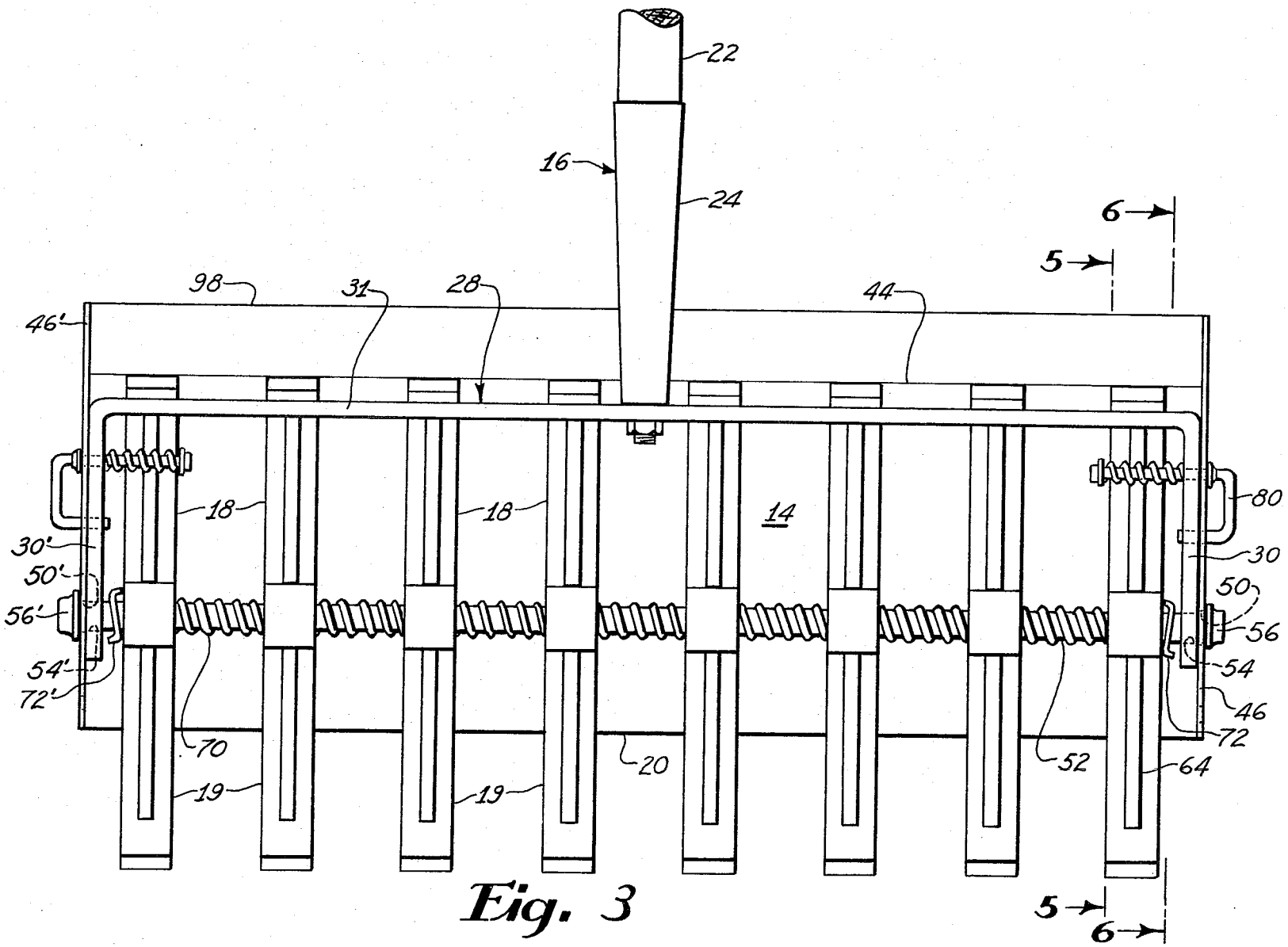
FIG. 3 is a plan view of the implement of the present invention with the blade oriented as in FIG. 1 for cleaning a corrugated surface.

Referring now to FIG. 3, the handle assembly 16 includes a U-shaped clevis 28 having end members 30,30' joined by a central member 31. The sleeve 24 is centrally affixed to the central member 31 of the clevis 28 by any suitable fastening means, the handle 22 being generally parallel to the end members 30,30' of the clevis 28 and extending in a direction opposite the direction of the end members 30,30'.

Figure 5:
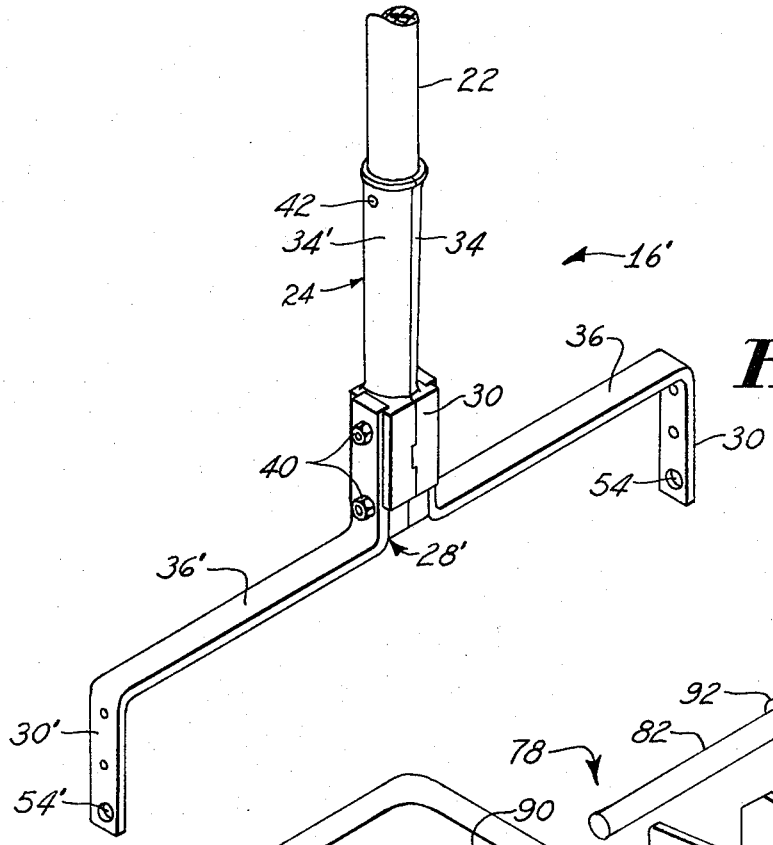
FIG. 5 is a pictorial view of one embodiment of a handle assembly of the implement of the present invention.

Referring briefly to FIG. 5, there is shown a preferred embodiment of the handle assembly 16' having sleeve 24 for receiving the handle 22, and formed integrally with the sleeve 24, a support block 30. The sleeve 24 and support block 30 are formed preferably in two opposing half-pieces 34,34' of cast aluminum. A pair of bracket members 36,36' are attached to the support block 25 to form therewith a clevis 28' similar in shape to the clevis 28 of FIGS. 2 and 3. Suitable fastening means such as bolts 40 and a rivet 42 hold the half-pieces 34,34' together. The bolts 40 serve also to attach the bracket members 36,36' to the support block 30; the rivet 42 serves also to retain the handle 22 inside the sleeve 24. The handle assembly 16' of FIG. 5 was found to have strength and durability superior to the handle assembly 16 embodiment described with reference to FIGS. 2 and 3.

Figure 4:
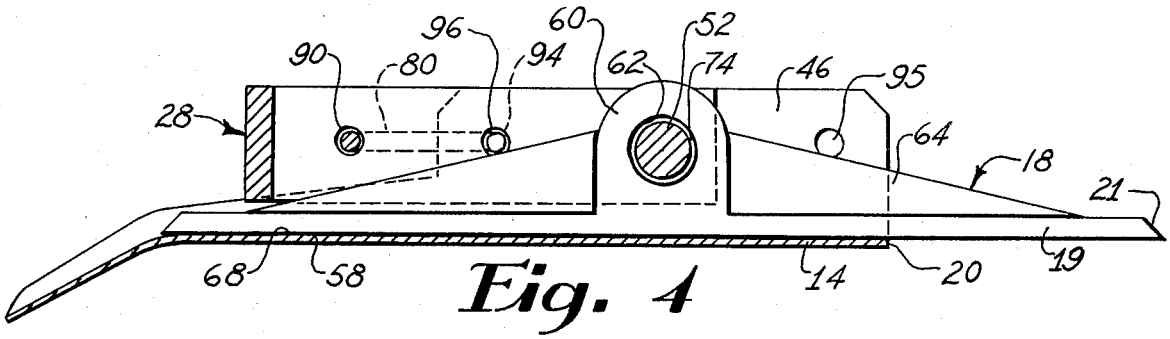
FIG. 4 is a view taken along lines 4—4 of FIG. 3 and shows a side view of a scraping member.
Figure 6:
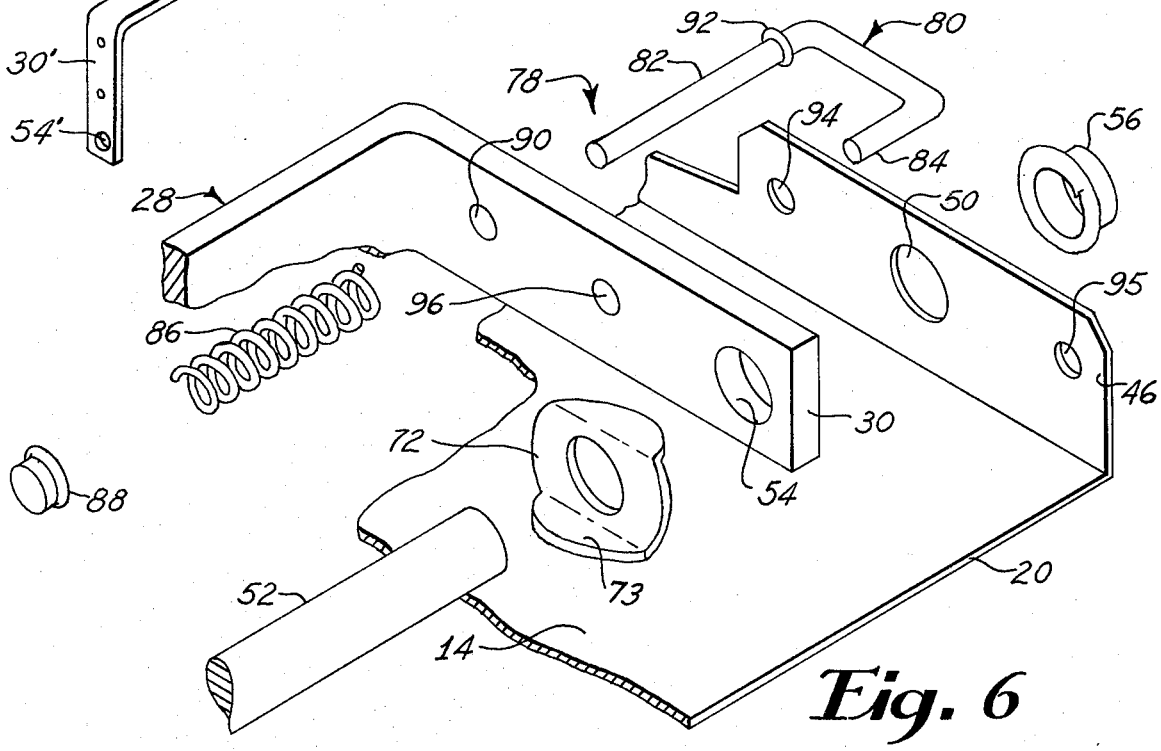
FIG. 6 is an exploded perspective view of the apparatus defined generally by lines 6—6 of FIG. 3.

Referring now to FIGS. 3–6, the blade 14 is an essentially planar element, rectangular in shape, and is preferably formed from a strong material such as galvanized sheet steel. To facilitate the scooping of ice, slush and the like, but primarily to add strength to the galvanized metal blade 14, the preferred embodiment of the blade 14 is formed by bending slightly along a line 44 parallel to the working edge 20. A bend angle from twenty to thirty degrees was found to be suitable to provide the strength desired. Oppositely disposed sides of the blade 14 are formed as by bending ninety degrees into flanges 46,46'. Referring now primarily to FIGS. 3,4 and 6, the flanges 46,46' have corresponding apertures 50,50' formed therein for receiving a shaft 52, the apertured flanges 46,46' serving as bearing members receiving journals of the shaft 52. The apertures 50,50' are located so that the shaft 52 is spaced apart from and oriented generally parallel to the plane of the blade 14. The end members 30,30' of the clevis 28 have apertures 54,54' formed therein for receiving the shaft 52. The handle assemble 16 and the blade 14 are thus both rotatably mounted to the shaft 52 and are independently rotatable about the shaft 52 with respect to one another. Retaining nuts 56,56' are pushed onto either end of the shaft 52.

Referring now to FIGS. 3 and 4, the scraping members 18 are symmetrical elements which may be formed by casting of a strong light-weight material such as alloys of aluminum or magnesium. Alternatively, the scraping members 18, may be formed by injection molding from a variety of plastic materials having high tensile strength and moderately low tensile elastic modulus. Suitable materials include nylon, acetal homopolymer, ETFE and ETCFE fluoroplastics, thermoplastic polyester, polysulfone, and polyamide. The plastic material utilized may be reinforced or filled to enhance one or more of its physical properties. The scraping members may also be stamped from sheet metal such as galvanized steel. Each of the scraping members 18 of the presently described embodiment is formed with a generally rectangular, flat surface 58, a hub 60, and a strengthening rib 64. The hub 60 is provided with a hole 62 therethrough for receiving the shaft 52. When the scraping members 18 are emplaced on the shaft 52, a major portion of the flat surface 58 of each scraping member 18 abuts the surface 68 of the blade 14, the shaft 52 holding the scraping members 18 against the blade 14. The remaining portion of the flat surface 58 extends outward in cantilevered fashion from the edge 20 of the surface 68, the outwardly extending portions of the scraping members 18 forming the teeth 19. Referring briefly to FIGS. 1 and 4, the teeth 19 fit into and serve to clean ice and debris from the channels 26 of the corrugated surface 12 in response to shoveling action applied to the tool 10, while the edge 20 rests on and scrapes the ridges 27 between the channels 26. The teeth 19 are formed with beveled ends 21 to provide a sharp cutting edge. The width of the teeth 19 is variable for manufacturing purposes but must be identical for all the scraping members 18 of one implement 10 in order to accommodate regularly spaced corrugations. The width of the teeth 19 may vary from 1.2 to 2.5 centimeters to accommodate most of the corrugation spacings now commonly found in refrigerated bodies. It may be desirable to carry at least one additional set of scraping members 18 with each implement, one set having a different width than the additional set.

Returning to FIGS. 3 and 4, the scraping members 18 are free to slide latterally with respect to the edge 20 along the shaft 52 and across the surface 68 of the blade 14; however, each scraping member 18 is constrained and separated on the shaft 52 from the scraping member 18 adjacent to it by a coil spring 70 having the shaft 52 extending slidably through the center thereof. The springs 70 are alike in length and strength.

Referring to FIGS. 3 and 6, a slidable retainer 72,72' is emplaced on the shaft adjacent to each of the outboard scraping members 18. The retainer 72,72' of the presently described embodiment is of the type which grasps the shaft 52 when tilted away from a perpendicular relationship therewith; however, any other type of slidable retainer or blocking means may be utilized, as for example, a metal block having a set screw therein or a clevis having a machine screw for grasping the shaft 52. The retainers 72,72' of the presently described embodiment may be loosened easily by manually forcing the retainer from the tilted position (as shown in FIG. 3) into a perpendicular relationship with the shaft 52. By loosening the retainer 72,72' at either or both ends of the shaft 52 and manually moving the outboard scraping members along the shaft 52 laterally with respect to the blade 14, the spacing between adjacent ones of the plurality of scraping members 18 may be altered, simultaneously. Both during the altering process and after the retainers 72,72' are reengaged or locked to the shaft 52, the plurality of scraping members 18 remains regularly spaced apart on the shaft 52 by the action of the coil springs 70. The retainers 72,72' are reengaged by the action of the outboard scraping members pushing on a tab 73 of the retainer to tilt the retainer away from a perpendicular relationship with the shaft 52. Additional scraping members 18 may easily be added when the spacing between the teeth 18 is made smaller, thus enabling more channels 26 to be cleaned. Similarly, some scraping members 18 may be removed when the spacings are made larger. Thus, any one of an infinite number of different spacings of the teeth 18 may be implemented by means of a quick and simple adjustment, easily done by hand without the aid of tools. When the implement 10 is being utilized for cleaning a corrugated surface as depicted in FIG. 1, the scraping members 18 are free to slide laterally along the shaft 52 under constraint of the coil springs 70 should any irregularities in the parallelism of the channels 26 be encountered. It is evident also that defective scraping members may be quickly and easily removed and replaced. The symmetry of the scraping members 18 serves to provide a plurality of spare teeth, allowing reversal of the scraping member 18 on the shaft 52, thereby removing from service a damaged or worn tooth, and replacing it with the spare tooth at the opposite end of the scraping member. Referring briefly to FIG. 4, it is noted that the hole 62 in the hub 60 is slightly larger than the cross-sectional diameter of the shaft 52, forming a space 74 between the shaft 52 and the hub 60. The hub 60 fitting loosely on the shaft 52 facilitates sliding of the hub 60 along the shaft, and further allows the scraping member 18 to wobble laterally on the shaft thus helping to prevent binding of the teeth 19.

Referring now to FIG. 6, a locking means 78 includes a U-shaped pin 80 having a longer tine 82 and a shorter tine 84, a coil spring 86, and a retaining nut 88. The end member 30 of the handle assembly 16 is provided with a hole 90 therethrough, into which the longer tine 82 of the pin 80 is slidably inserted. The coil spring 86 slidably surrounds the longer tine 82 passed through the hole 90, and is held on the tine 82 by the retaining nut 88; the spring 86 serves to hold the pin 80 in place by pressure exterted on the locking nut 88. A flange 92 holds the U-shaped pin 80 spaced apart from the end member 30 to allow grasping it with the fingers. The shorter tine or locking pin 84 is passed through one of two holes 94,95 in the flange 46 (depending on the position of the end member 30 relative to the flange 46) and a locking pin hole 96 in the end member 30, thus locking the handle assembly 16 and the blade 14 together in one of the two working positions. The locking means 78 is disengaged by pulling the U-shaped pin 80 outwardly against the force of the spring 86 to free the locking pin 84. Referring to FIGS. 1,2, and 6, the locking pin 84 is inserted through the hole 94 when the handle assembly 16 and blade 14 are oriented for use of the teeth 19 as shown in FIG. 1; when the blade 14 and handle assembly 16 are oriented for use as a conventional shovel as shown in FIG. 2, the locking pin 84 is inserted through the hole 95 in the flange 46. When oriented in the conventional-shovel position, a second working edge 98 of the blade 14 parallel to and oppositely disposed from the first working edge 20 is placed in the working position as shown in FIG. 2, while the edge 20 is placed in the non-working position. The shaft 52 is intermediate the first working edge 20 and the second working edge 98 of the blade 14, and parallel to both edges 20,98. The shaft 52 is spaced apart from the plane of the blade only by the closest distance (see FIG. 4) between the flat surface 68 and the periphery of the hole 62 which distance is relatively small when compared with the respective distances between the shaft 52 and the working edges 20,98. Consequently, it can be stated that with respect to the operation of the implement 10 whereby the configuration and use of the implement are changed by rotating the blade, the shaft 52 which is the axis of rotation of both the blade 14 and the teeth 19 is essentially coplanar with the first and second working edges 20,98 of the blade 14.

I have described above, the preferred embodiment of a novel hand-manipulable implement for cleaning corrugated surfaces such as those found inside refrigerated bodies of trucks, trailers and other containers. The tool is provided in one configuration with a blade having a plurality of teeth for scraping out the channels or grooves of the corrugated surface by shoveling or scooping action, while the blade scrapes the ridges of the corrugation and accumulates the debris as would a conventional shovel. In another configuration the tool serves as a conventional scoop or shovel for clearing away the accumulated icy debris.

While the principles of my invention have now been made clear in the foregoing description, there will be immediately obvious to those skilled in the art many modifications of structure, arrangement, proportions, the elements, materials and components used in the practice of the invertion, and otherwise, which are particularly adapted for specific enviroments and operating requirements without departing from those principles. The apended claims are therefore, intended to cover and embrace any such modifications, within the limits only of the true spirit and scope of the invention.

What is claimed is:

1. An improved hand manipulable implement for cleaning a surface of the type having essentially straight, parallel, and regularly spaced apart channels and ridges, said implement being of the type having an elongate handle, a generally planar blade, means for attaching the handle to the blade in general coplanar relationship therewith, the blade including a first working edge perpendicular to the handle and oppositely disposed on the blade from the handle, and a plurality of scraping members attached to the blade, each of said scraping members including a tooth extending outward from the first working edge, each one of said plurality of scraping members being spaced apart from an adjacent one of said plurality of scraping members by an equal distance, the teeth of said plurality of scraping members being arranged to fit into the channels of the surface, the first working edge resting on the ridges, where by shoveling action imparted to said implement foreign matter is scraped from the channels and ridges of the surface, wherein the improvement comprises: means intermediate adjacent ones of said plurality of scraping members for resiliently holding said scraping members regularly spaced apart, each one of said plurality of scraping members being slidable laterally with respect to the blade along the first working edge under constraint of said holding means, whereby during the shoveling action and in response to an irregularity of a corresponding one of the channels in which the tooth of said one scraping member fits, said one scraping member is moved laterally to accommodate the irregularity and prevent binding of the teeth of said plurality of scraping members in the channels.

2. The improved implement as claimed in claim 1, wherein the improvement further comprises: means cooperating with said holding means for simultaneously adjusting said plurality of scraping members laterally with respect to the blade along the first working edge to change the magnitude of the distance spaced apart of each of said plurality of scraping members while maintaining the equality of the distance spaced apart of each of said plurality of scraping members.

3. The improved implement as claimed in claims 1 or 2, wherein the blade includes a second working edge parallel to and oppositely disposed on the blade from the first working edge, said second working edge being in a non-working position and the first working edge being in a working position; and the attaching means including means for rotating the blade with respect to the handle about an axis essentially coplanar with the blade, parallel to and intermediate the first and second working edges, whereby 180° rotation of the blade with respect to the handle places the first working edge and said scraping members in the non-working position and the second working edge in the working position.

4. The improved implement as claimed in claim 1, further comprising: each of said plurality of scraping members being essentially symmetrical and including a spare tooth oppositely disposed from the first tooth, the spare tooth abutting a surface of the blade, each of said scraping members being detachable from said blade and reattachable with the first tooth and the spare tooth transposed, thereby substituting the spare tooth for the first tooth in the event of damage to the first tooth.

5. A shovel for cleaning a corrugated surface of the type having essentially straight, parallel, and regularly spaced apart grooves and ridges, said shovel comprising:

an elongate handle;

an essentially planar blade attached to said handle and essentially coplanar therewith, said blade having an edge perpendicular to said handle and oppositety disposed on said blade from said handle;

a plurality of teeth slidably attached to said blade, said teeth arranged along the edge and extending outwardly therefrom in a direction opposite said handle, said teeth being individually slidable laterally with respect to said blade along the edge; and means intermediate adjacent ones of said plurality of teeth for resiliently holding said teeth regularly spaced apart along the edge, said teeth arranged to fit loosely into the grooves of the corrugated surface when the edge rests on the ridges thereof, whereby foreign matter is removed from the corrugated surface in response to shoveling action.

6. The shovel as claimed in claim 5, further comprising:

means adjacent outboard ones of said plurality of teeth for blocking the movement of said outboard teeth in an outboard direction, said blocking means being disengageable and laterally slidable with respect to said blade to allow changing the magnitude of the spacing between the adjacent ones of said plurality of teeth.

7. The shovel as claimed in claims 5 or 6, further comprising:

said blade having another edge parallel to the first edge and oppositely disposed on the blade from the first edge, the first edge being in a working position, and the other edge being in a non-working position adjacent said handle; and means for rotating said blade with respect to said handle to transpose the first edge and the other edge, the first edge and said plurality of teeth being in the non-working position and the other edge being in the working position.

8. The shovel as claimed in claim 7, wherein said rotating means includes a shaft parallel to the first edge and the other edge of said blade, said handle and said blade being rotatably attached to said shaft.

9. The shovel as claimed in claim 8, wherein each of said plurality of teeth includes an aperture therethrough, said shaft extending through each of the apertures, said shaft serving to hold each of said plurality of teeth abutting said blade, said holding means being disposed on said shaft between said teeth.

10. A hand-manipulable implement, comprising:

a generally rectangular blade having first and second parallel and oppositely disposed working edges and first and second oppositely disposed sides, each of the sides having therein a journal receiving means;

a shaft rotatably mounted at either end thereof in the journal receiving means, said shaft being parallel to and spaced apart a first distance from the plane of said blade, said shaft parallel to the first and second working edges;

a plurality of scraping members each including a flat elongate and generally rectangular surface, and a centrally disposed hub having a pivot hole therethrough for receiving said shaft, the pivot hole being parallel to the flat rectangular surface of said scraping member and perpendicular to a longitudinal axis thereof, the pivot hole being spaced apart from the plane of the flat surface by said first distance, said shaft extending through each of the pivot holes, said shaft holding said plurality of scraping members against said blade, a major portion of said flat surface abutting said blade and a remaining portion of the surface extending outward in cantilevered fashion from the first working edge of said blade, said plurality of scraping members being slidable along said shaft laterally with respect to the first working edge;

means attachable to said shaft for blocking outboard ones of said plurality of scraping members from sliding further outboard on said shaft from said blocking means;

a plurality of coil springs each having said shaft extending through a central passage thereof, each of said plurality of scraping members being held spaced apart on said shaft from an adjacent one of said scraping members by one of said coil springs, said scraping members being regularly spaced along said shaft, each of said scraping members being free to slide laterally along the shaft within the constraints of said plurality of coil springs and said blocking means, said blocking means being slidable along said shaft to alter the spacing between said plurality of scraping members;

a handle assembly having an elongate handle, and a U-shaped clevis having two mutually parallel end members joined by a central member, each of the end members having a hole therethrough for receiving said shaft, the handle being affixed at one end thereof to the central member of the clevis midway between the end members, the handle being parallel to the end members and extending from the central member in a direction opposite the end members, said handle assembly rotatably attached to said shaft through the holes of the end members; and means engageable with said blade for locking said blade and said handle assembly together with the axis of the handle essentially parallel with the plane of said blade, the first working edge of said blade and the outwardly extending portions of said scraping members being in a working position oppositely disposed from said handle assembly, the second working edge being oriented in a non-working position adjacent said handle assembly, said blade being rotatable about said shaft with respect to said handle assembly when said locking means is disengaged to transpose the first and second working edges, said locking means being further engageable with said blade oriented with the second working edge in the working position and the first working edge in the non-working position.

11. The shovel as claimed in claim 10, further comprising: each of said plurality of scraping members being longitudinally symmetrical about the pivot hole, said scraping members being reversable to transpose the portion extending outward from the first working edge and the portion abutting said blade.

12. A shovel for cleaning corrugated surfaces, comprising:

a handle;

a blade;

means for attaching said handle to said blade in general coplanar relationship, said blade including a first working edge oppositely disposed from said handle;

a plurality of scraping members, each having a first tine projecting outward from the first working edge of said blade;

means for slidably attaching said plurality of scraping members to said blade, said scraping members being laterally moveable along the first working edge;

means for blocking the lateral movement in an outboard direction of two outboard ones of said plurality of scraping members; and means for resiliently holding said plurality of scraping members regularly spaced apart along the first working edge.

13. The shovel as claimed in claim 12, wherein each of said plurality of scraping members is longitudinally symmetrical, each of said scraping members including a second tine oppositely disposed from the first tine, each of said plurality of scraping members being detachable from said blade and reattachable with the first and second tines transposed.

14. The shovel as claimed in claims 12 or 13, wherein said holding means comprises a plurality of springs having essentially identical resilience and strength, one of the plurality of springs being intermediate each adjacent pair of said plurality of scraping members.

15. The shovel as claimed in claims 12 or 13, wherein said plurality of scraping members each includes a hole therethrough; and said attaching means comprises a shaft attached to said blade, the shaft passing through each of the holes of said plurality of scraping members.

16. The shovel as claimed in claim 15, wherein said holding means comprises a plurality of coil springs having essentially identical resilience and strength, each of the plurality of coil springs surrounding the shaft, one of the coil springs being intermediate each adjacent pair of said plurality of scraping members.

* * * * *